US008881344B2

(12) United States Patent
Akin

(10) Patent No.: US 8,881,344 B2
(45) Date of Patent: Nov. 11, 2014

(54) VACUUM CLEANER HAVING A WATER RECEPTACLE WITH NO FASTENING MEANS THEREINBETWEEN

(75) Inventors: Hasan Akin, Istanbul (TR); Senur Akin Biçer, legal representative, Istanbul (TR); Mehmet Serhan Akin, legal representative, Istanbul (TR)

(73) Assignee: Senur Elektrik Motorlari San. Ve Tic. A.S., Istanbul (TR)

( * ) Notice: Subject to any disclaimer, the term of this patent is extended or adjusted under 35 U.S.C. 154(b) by 0 days.

(21) Appl. No.: 13/504,388

(22) PCT Filed: Oct. 27, 2010

(86) PCT No.: PCT/EP2010/066257

§ 371 (c)(1),
(2), (4) Date: Apr. 26, 2012

(87) PCT Pub. No.: WO2011/051336

PCT Pub. Date: May 5, 2011

(65) Prior Publication Data

US 2012/0240349 A1 Sep. 27, 2012

(30) Foreign Application Priority Data

Oct. 27, 2009 (TR) ..... a 2009/08122

(51) Int. Cl.
*A47L 9/18* (2006.01)
*A47L 9/22* (2006.01)

(52) U.S. Cl.
CPC . *A47L 9/22* (2013.01); *A47L 9/182* (2013.01); *A47L 9/185* (2013.01); *A47L 9/181* (2013.01)
USPC ..... 15/353; 96/278; 96/279

(58) Field of Classification Search
USPC ..... 15/353; 96/355, 361, 277; 261/116, 118
See application file for complete search history.

(56) References Cited

U.S. PATENT DOCUMENTS 5,752,997 A * 5/1998 Roth ..... 96/342
5,776,215 A * 7/1998 Amoretti ..... 96/247
6,814,788 B2 * 11/2004 Barazza et al. ..... 96/277

FOREIGN PATENT DOCUMENTS

EP 0119423 * 2/1994

* cited by examiner

*Primary Examiner* — David Redding
(74) *Attorney, Agent, or Firm* — Nath, Goldberg & Meyer; Jerald L. Meyer

(57) ABSTRACT

The electrical household appliance of the invention comprises a vacuum cleaner comprising a water receptacle having a water filter, said water receptacle having an emptied front part and an emptied rear part, said emptied rear part receiving a motor projection from below such that the bottom surface of said receptacle is perpendicular to the longitudinal axis of said motor and said emptied front part is designed to accommodate a suction hose slot, said suction hose coaxially communicating with an inlet shaft of said water filter from below, said inlet shaft extending perpendicular to the bottom surface of said receptacle.

6 Claims, 16 Drawing Sheets

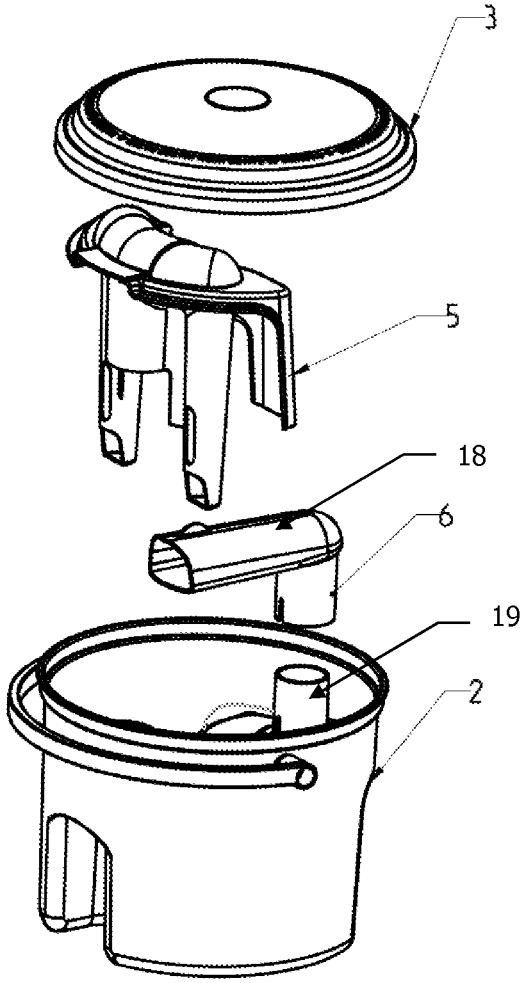
Fig. 16
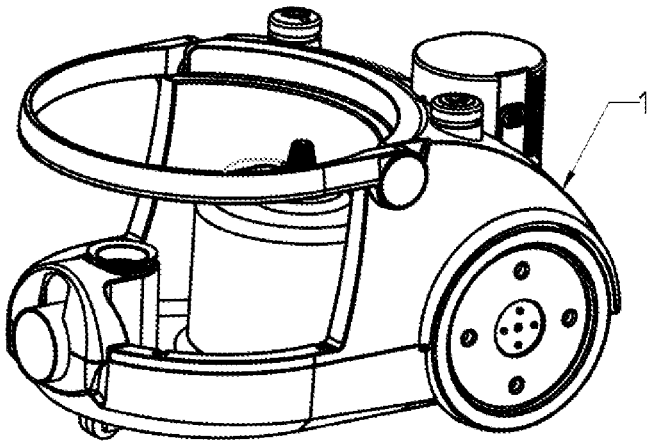

VACUUM CLEANER HAVING A WATER RECEPTACLE WITH NO FASTENING MEANS THEREINBETWEEN

This is a National Phase Application filed under 35 U.S.C. §371 as a national stage of International Application No. PCT/EP2010/066257, filed Oct. 27, 2010, claiming the benefit from Turkish Patent Application No. 2009/08122, filed Oct. 27, 2009, the entire content of each of which is hereby incorporated by reference in its entirety.

TECHNICAL FIELD OF THE INVENTION

The present invention pertains to a vacuum cleaner directing contaminated air into a water canister through which particles are filtered out. More particularly, the present invention proposes a vacuum cleaner which does not involve any fastening elements to fix a filtering purpose water receptacle onto the cleaner body.

BACKGROUND OF THE INVENTION

Vacuum cleaners are known in prior art. The conventional vacuum cleaners have a body with an electrical motor sucking the air with the dirt to be filtered through a tube and put filtered air back into circulation. Vacuum cleaners are especially intended to clean dust in carpets and on the floor, usually containing an enormous amount of micro-level dust. The sucked air is then introduced to the filter in the form of a dust-collecting bag. The air allowed into the surrounding environment does, however, mostly contain micro-level dust, which was not kept by the closely-woven material of the dust-collecting bag.

Prior art vacuum cleaners with water filters are also deficient in that they are mainly heavy and also bulky in terms of the space they occupy. Those further require that motor housing be removed to reach the water filter in which contaminating particles are entrapped. Removal of the motor and also dismantling the water filter necessarily involves unlocking of a series bearings, which in turn brings about an additional impracticality. Therefore cleaning of the water filter is not practical as it is not easily accessible. It is therefore desirable to obtain a water filter type vacuum cleaner having an easily and directly accessible filtering and debris collecting tank without dismantling any parts or bearings and as easily as just lifting a bucket.

Water filter as such emptied and filled with fresh water can be reinstalled as easily as just dropping a bucket on the floor. A water filter requiring no connection parts or bearings at all to properly fix the same is a grand advantage because anybody with practically no experience in using tools such as wrenches, or having no particular knowledge on how to fix a mechanical part in a secure manner into another mechanical part could do it.

Another advantage which is in fact also a very important one is that elimination of mechanical connection elements lead to reduction in overall costs. A household appliance requiring a reduced number of fittings and fastening means such as bolts, nuts, clips, and clamps is advantageous as it involves simplicity and necessitates less man-hour work. A system consisting of a limited number of components is also advantageous in that it requires maintenance to a lesser extent.

OBJECTS OF THE INVENTION

Primary object of the present invention is to provide a vacuum cleaner which does not require removal of the motor casing and dismantling the water filter by way of unlocking a plurality of bearings, which is instead easily cleanable by removing water receptacle having no fastening means to be secured to the vacuum cleaner.

Another object of the present invention is to provide a vacuum cleaner having a water filter, which is not heavy and bulky in terms of the space occupied.

Another object of the present invention is to provide a vacuum cleaner requiring a reduced number of fittings and fastening means such as bolts, nuts, clips, and clamps, therefore involving simplicity and necessitating less man-hour work during manufacture.

SUMMARY OF THE INVENTION

The present invention proposes a vacuum cleaner having a water receptacle with a front part and a lower rear emptied part. Said emptied part is suitable for receiving a motor projection part from below such that said water receptacle is fixed onto the body of the vacuum cleaner. The receptacle requires no fastening means in the form of bearings or fittings for establishing a secure connection with the vacuum cleaner body but the vacuum lock effect of the motor which communicates with the receptacle from below, i.e. at the lower rear emptied portion ensures that said receptacle remains fixed during vacuuming operation. Therefore such a design involving vacuuming applied from below said receptacle ensures a simpler and practical design.

Said receptacle's front portion is designed to accommodate a water filter whose main inlet shaft coaxially communicates with a suction hose such that said front part of said receptacle is emptied to allow joining of said suction hose from below said emptied front portion. Said inlet shaft extend perpendicular to the water surface in the receptacle.

Said water filter additionally comprises beside said inlet shaft, a top portion in the uppermost region of the receptacle and in fluid communication with said inlet shaft and extending parallel to the water surface in the receptacle. Said top portion divides into two separate tubes at both sides of said inlet shaft such that each tube advance parallel to the water surface along an uppermost part of the receptacle and then perpendicular to the water surface in the direction thereof. Said tubular portions perpendicular with respect to the water surface extend around both sides of said emptied suction hose portion in the front part of said receptacle.

Said water filter comprises a front and a rear wing extending perpendicular to the water surface. Said front wing extend between said tubular portions, defined as air exit posts, and said emptied suction hose portion such that they bear against the lateral wall of said emptied suction hose portion, preventing liquid passage thereinbetween. Rear wing of the water filter, on the other hand, extend also perpendicular to the water surface and a certain distance behind said air exit posts. Said rear wing also bear against the lateral wall of the receptacle to prevent liquid passage thereinbetween. To this end, said front and rear wings define a region within which said air exit posts extend parallel to said wings and perpendicular to the water surface. The water being filled to a certain level in said receptacle, said front and rear wings does not reach the water surface.

The present invention provides an air evacuation extension guiding filtered air under vacuuming action such that building up of water ways on the inner surface of the receptacle lid on top of the motor region is prevented. This eliminates risk of liquid leakage into the motor components. Water ways on the inner surface of the receptacle lid is mainly comprised of a large number of water droplets reaching the upper surface of the receptacle due to a large number of bubbles rising to the water surface and collapsing under vacuuming action.

BRIEF DESCRIPTION OF THE FIGURES

Accompanying drawings are given solely for the purpose of exemplifying a vacuum cleaner whose advantages over prior art were outlined above and will be explained in detail hereinafter:

FIG. 14 (*b*) demonstrates a perspective view of the air evacuation shaft of the water filter according to the present invention.

FIG. 15 (*b*) demonstrates a top view of the air evacuation shaft of the water filter according to the present invention.

FIG. 16 demonstrates an exploded perspective view of the household appliance with the water filter assembly according to the present invention FIG. 17 demonstrates a lateral cross-sectional view of the household appliance with the water filter assembly according to the present invention

DETAILED DESCRIPTION OF THE INVENTION

Figure 1:
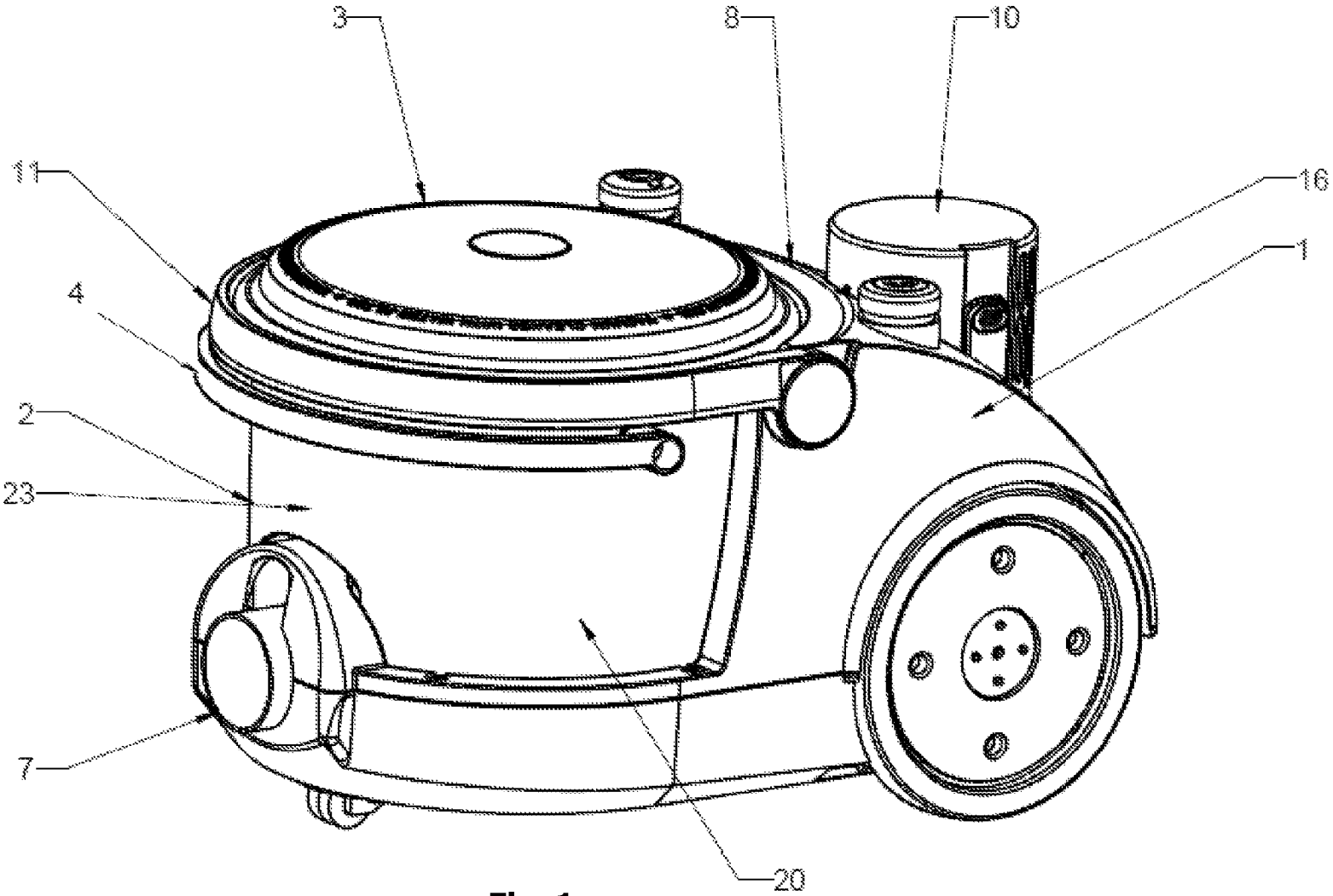
FIG. 1 demonstrates a general perspective view of the household apparatus according to the present invention.
Figure 2:
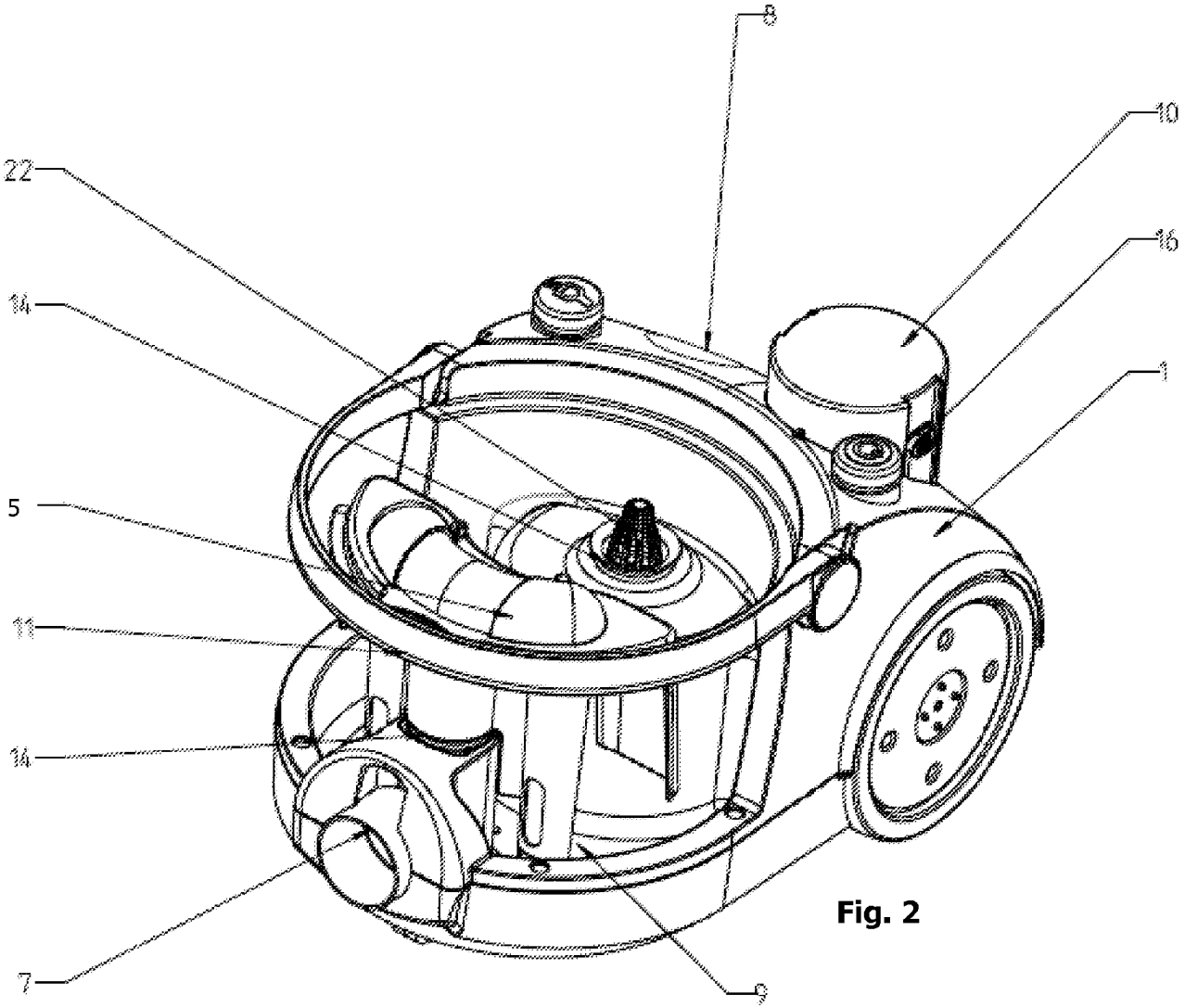
FIG. 2 demonstrates a perspective view of the household apparatus with the water filter assembly according to the present invention.
Figure 3:
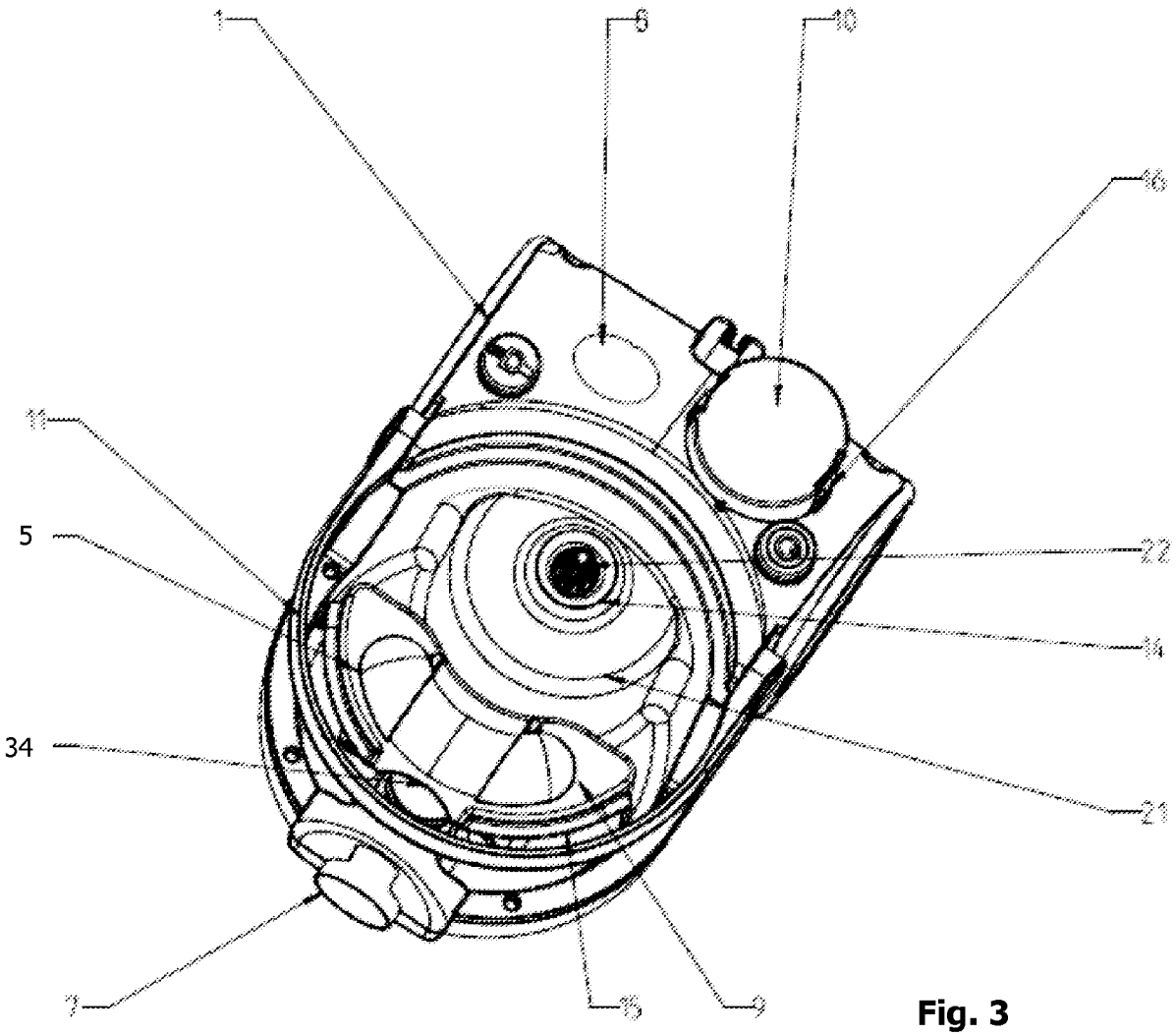
FIG. 3 demonstrates another perspective view of the household apparatus with the water filter assembly according to the present invention.
Figure 4:
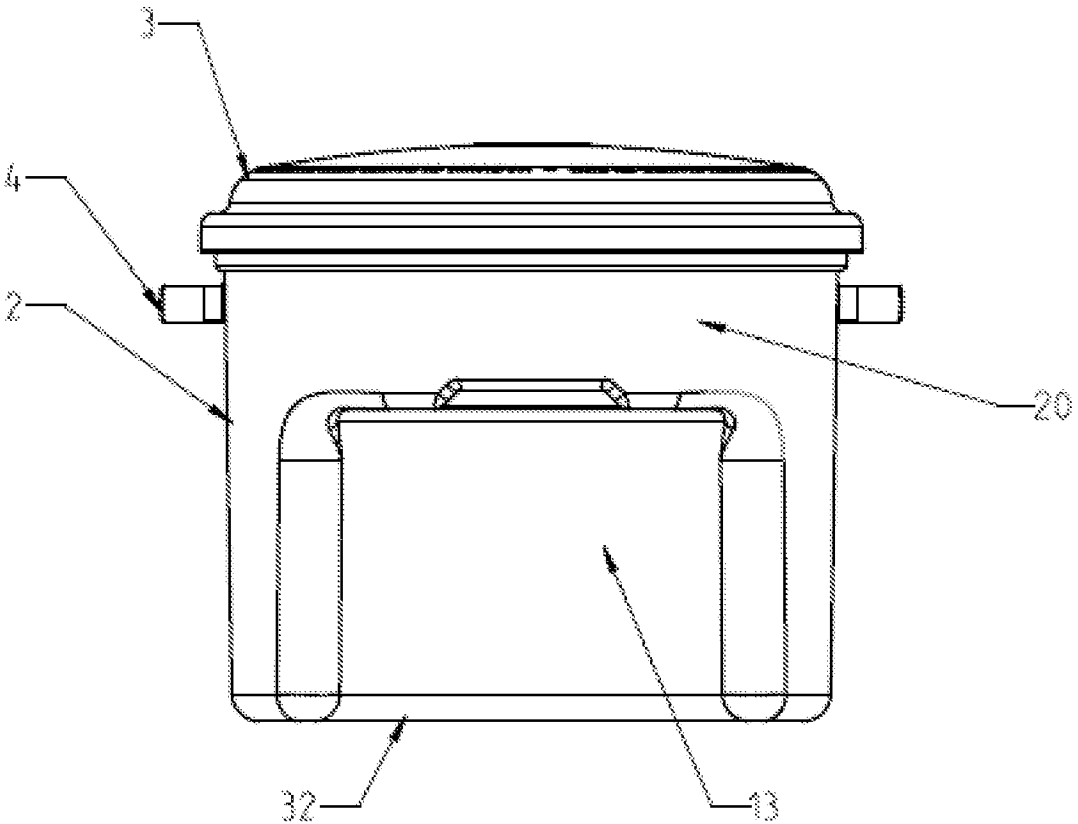
FIG. 4 demonstrates a planar rear view of the water filter assembly according to the present invention.
Figure 5:
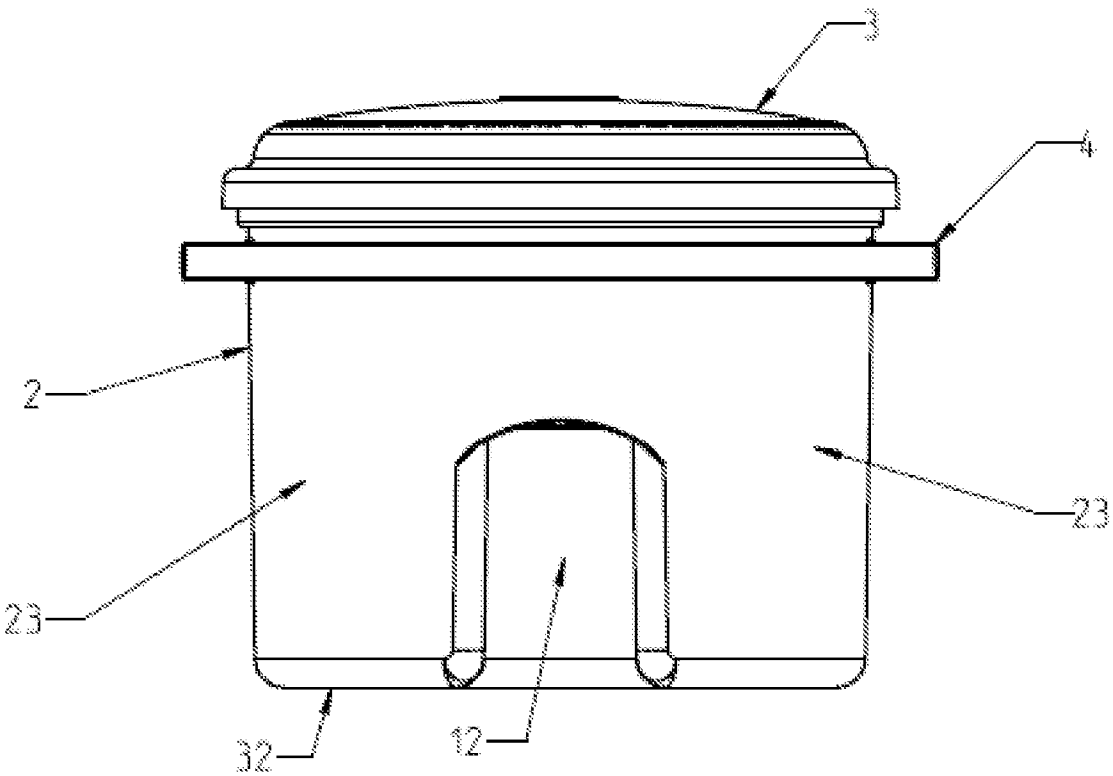
FIG. 5 demonstrates a planar front view of the water filter assembly according to the present invention.
Figure 6:
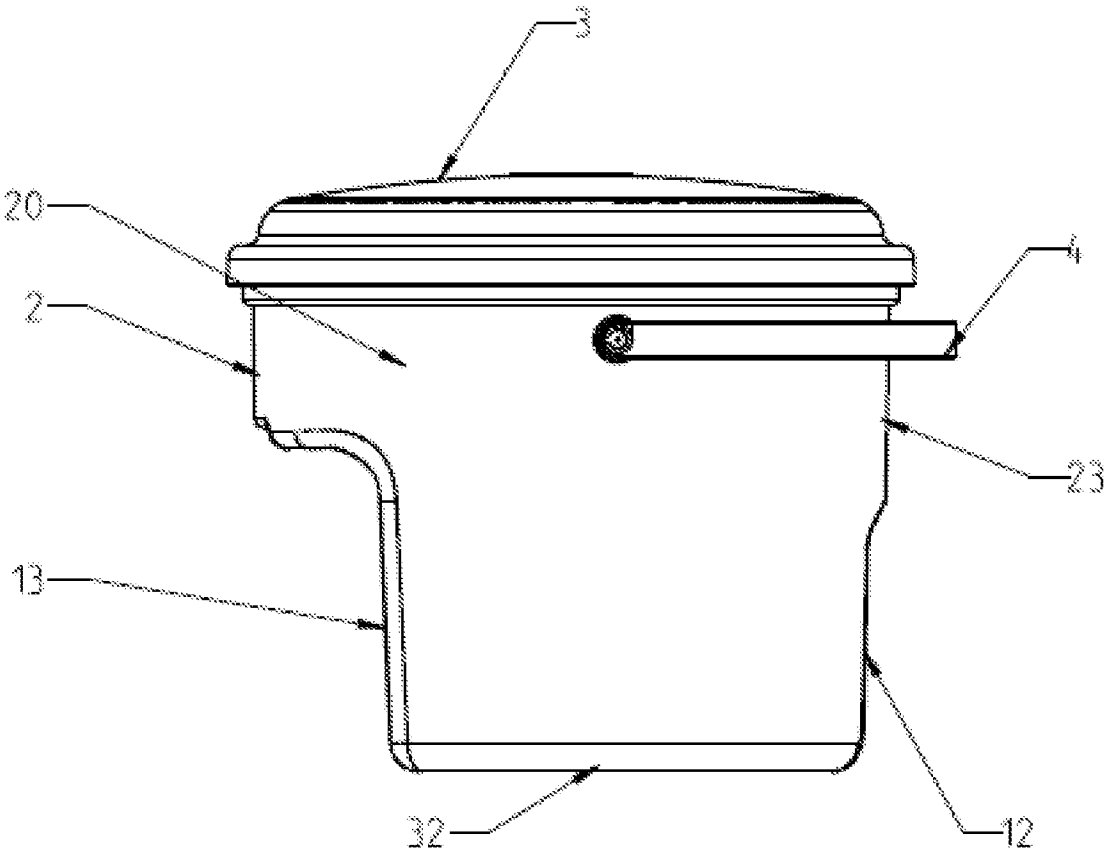
FIG. 6 demonstrates a planar side view of the water filter assembly according to the present invention.
Figure 7:
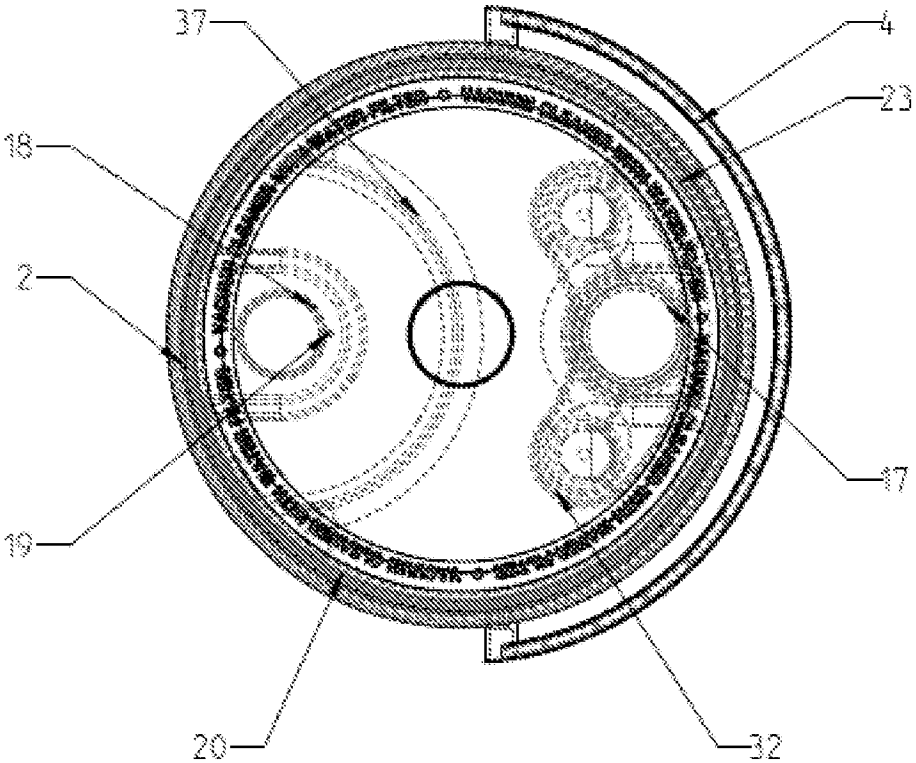
FIG. 7 demonstrates a top view of the water filter assembly according to the present invention.
Figure 8:
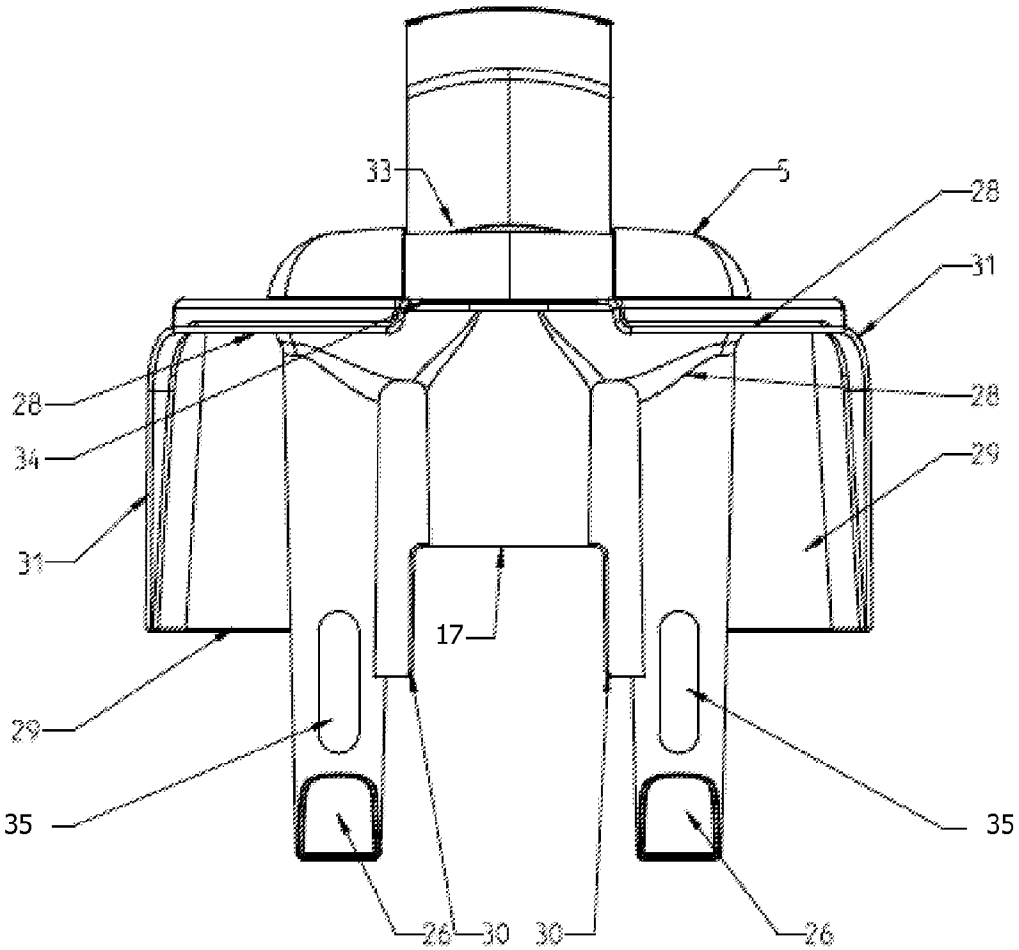
FIG. 8 demonstrates a planar front view of the water filter according to the present invention.
Figure 9:
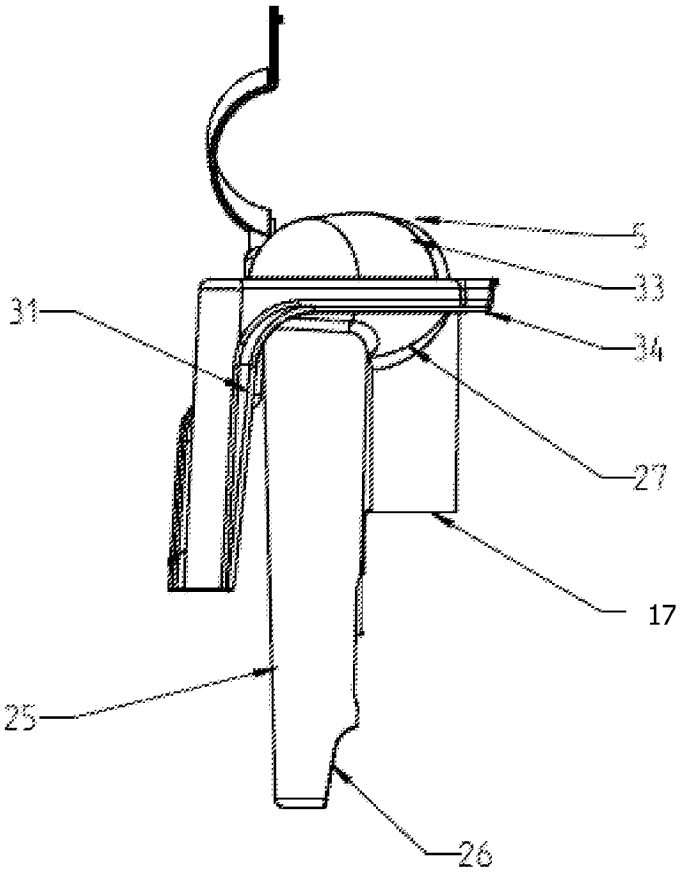
FIG. 9 demonstrates a planar side view of the water filter according to the present invention.
Figure 10:
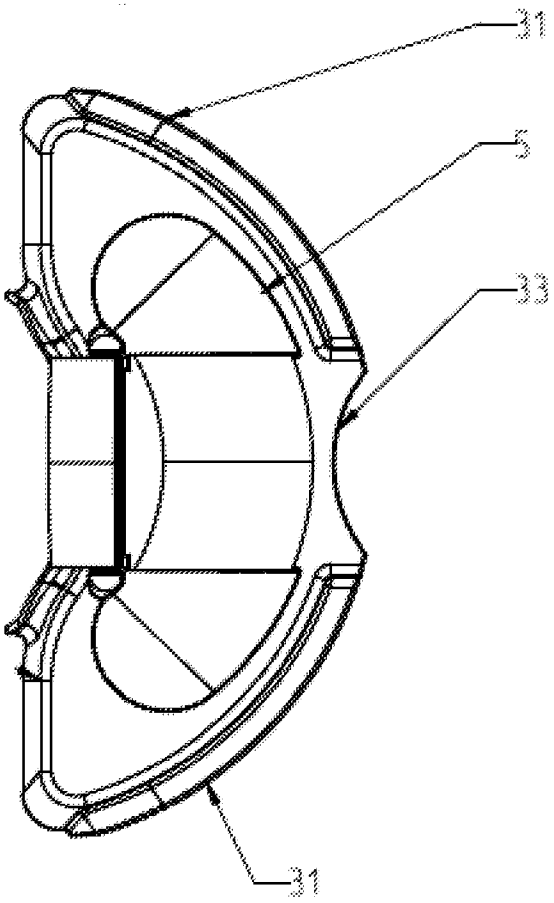
FIG. 10 demonstrates a planar top view of the water filter according to the present invention.
Figure 11:
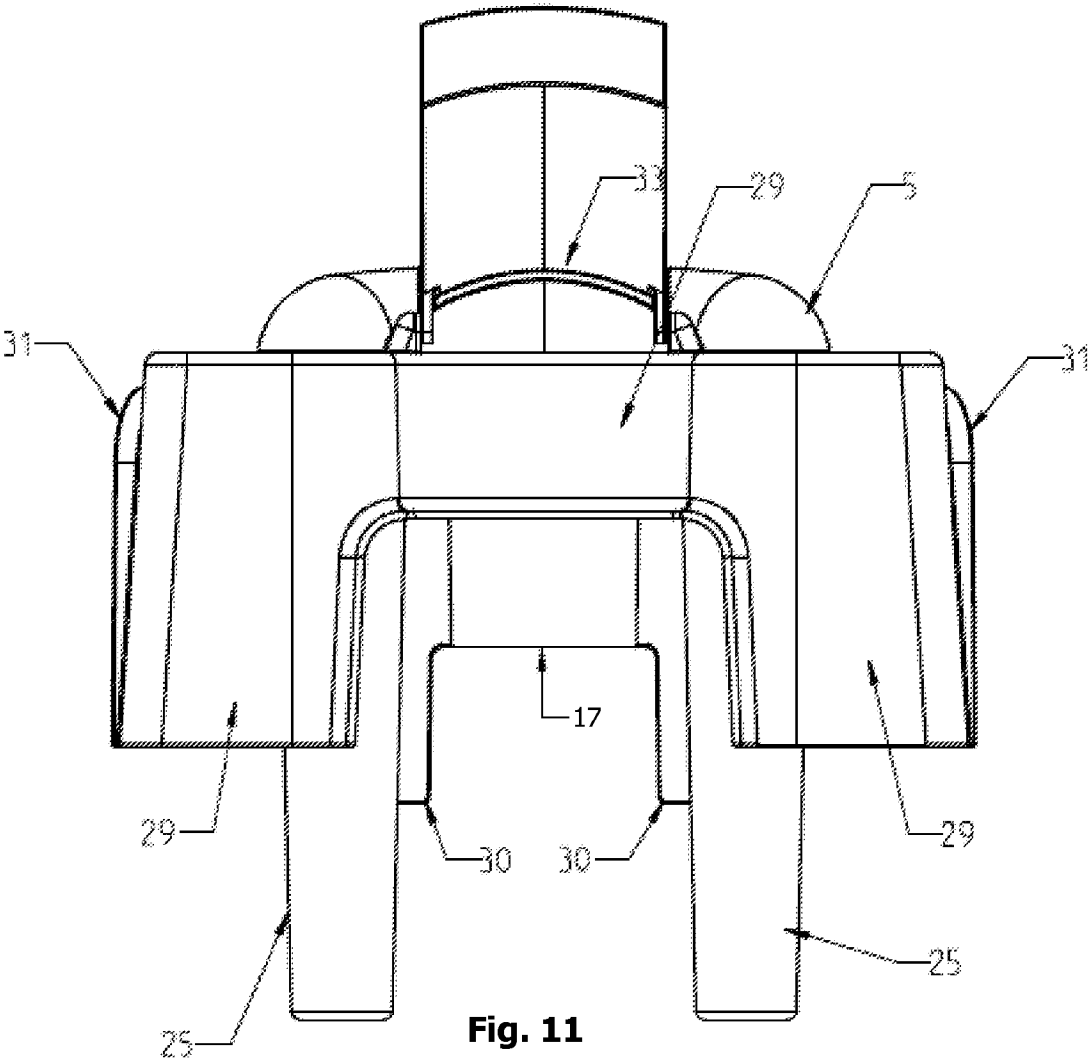
FIG. 11 demonstrates a planar rear view of the water filter according to the present invention.
Figure 12:
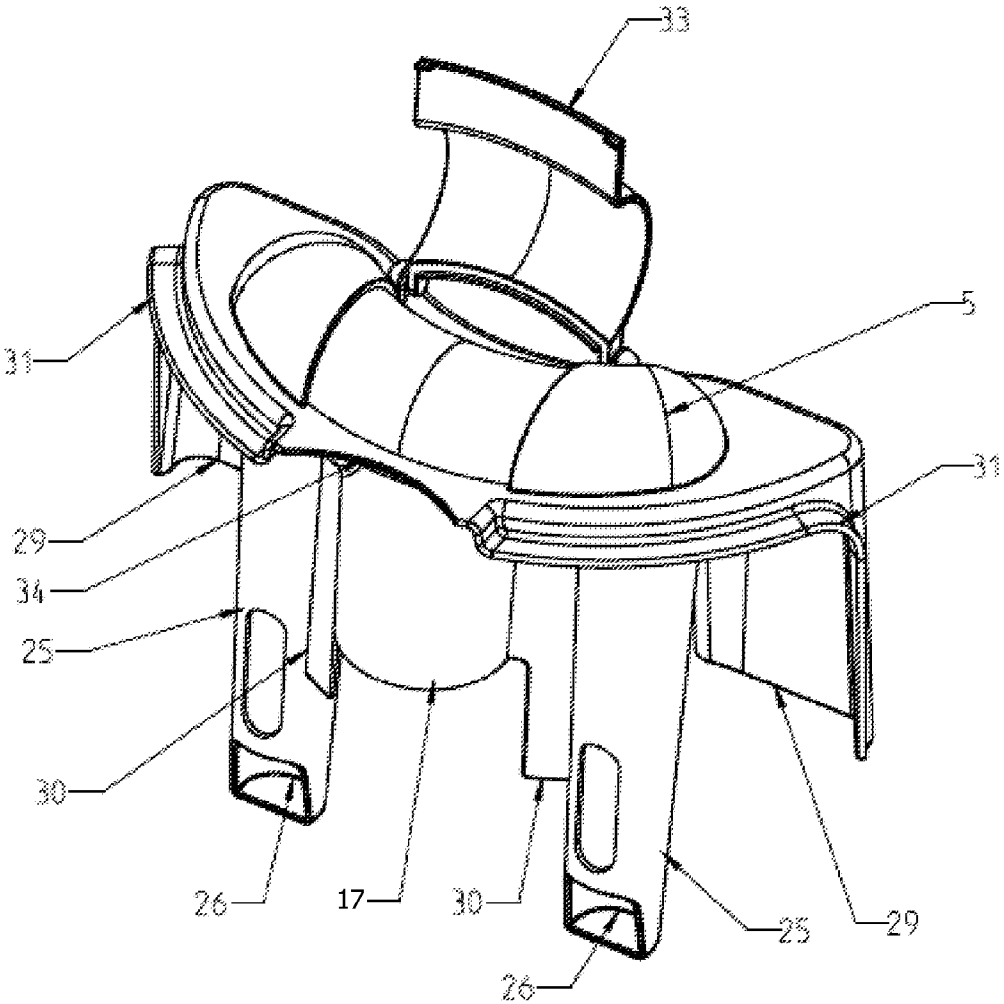
FIG. 12 demonstrates a perspective view of the water filter according to the present invention.
Figure 13:
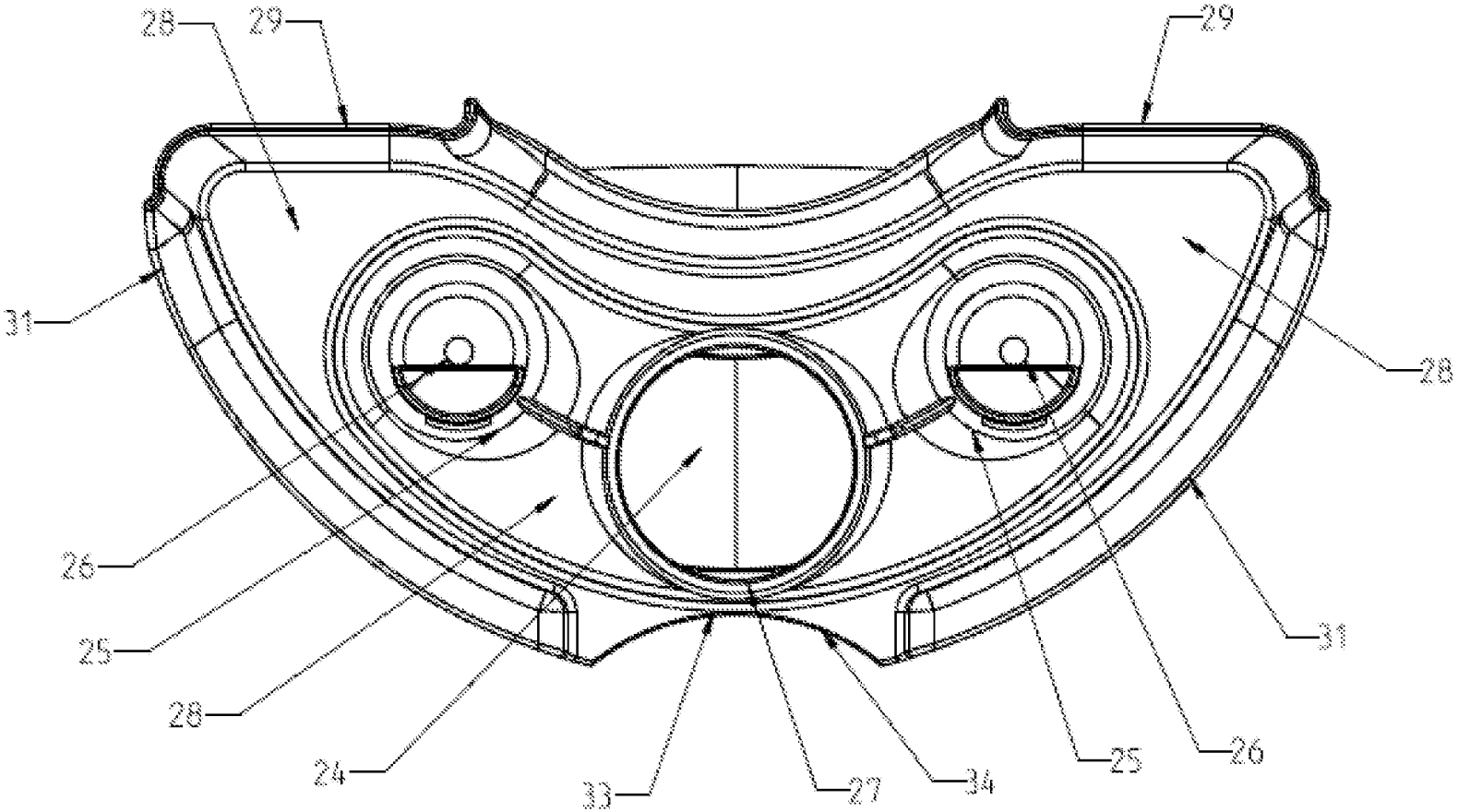
FIG. 13 demonstrates a planar top view of the water filter according to the present invention.
Figure 15A:
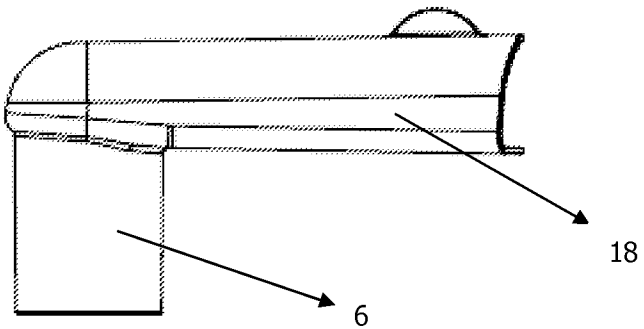
FIG. 15 (*a*) demonstrates a side view of the air evacuation shaft of the water filter according to the present invention.
Figure 15B:
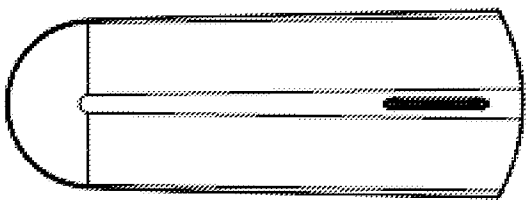
Figure 14A:
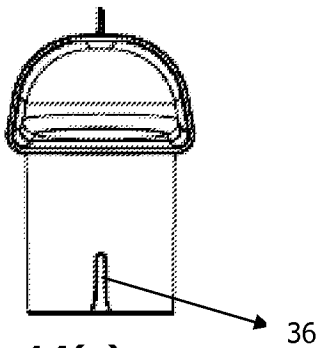
FIG. 14 (*a*) demonstrates a planar front view of the air evacuation shaft of the water filter according to the present invention.
Figure 14B:
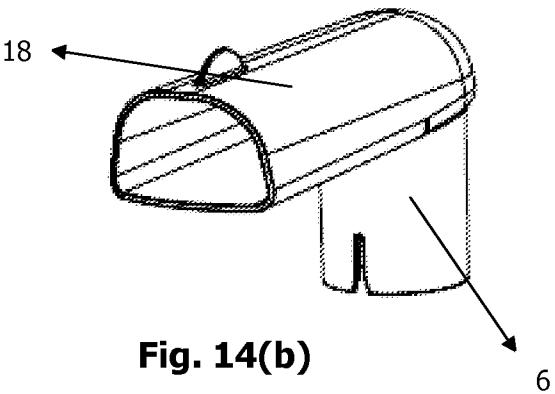
Figure 17:
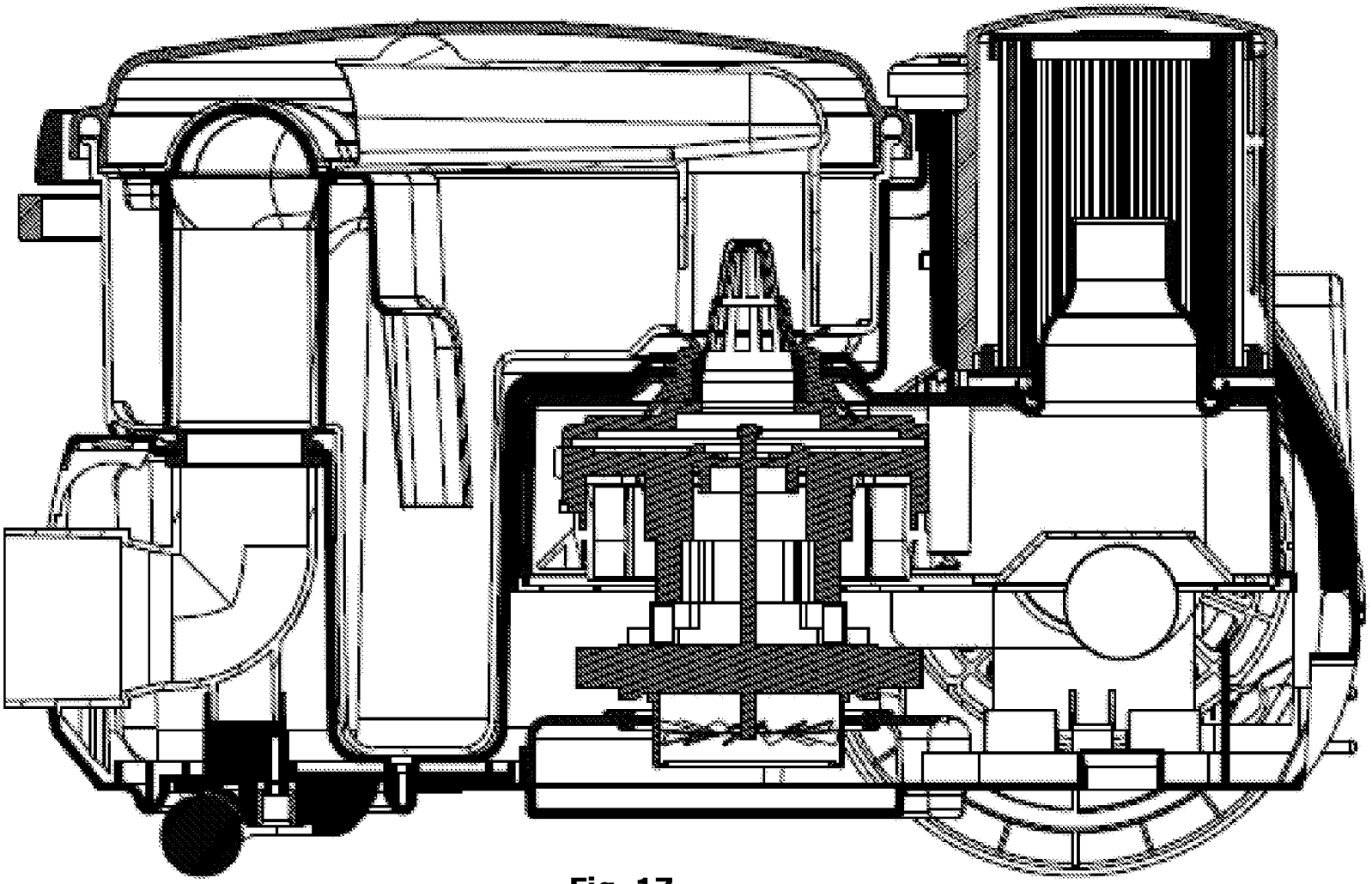

Referring now to the figures outlined above, the present invention proposes an electrical household appliance which is referred to in accordance with the following numerals throughout this description.

1 Main Housing
2 Water Receptacle
3 Receptacle Lid
4 Receptacle Handle
5 Water Filter
6 Air Evacuation Extension
7 Suction Hose Junction
8 Motor
9 Planar Lower Body Portion
10 Air Filter
11 Main Housing Handle
12 Suction Hose Slot
13 Emptied Receptacle Portion
14 Sealing
15 Water Evacuation Hole
16 Air Filter Clip
17 Water Filter Inlet Shaft
18 Air Evacuation Shaft
19 Evacuation Extension Guiding Protrusion
20 Receptacle Body
21 Motor Projection
22 Motor Air Intake Grid
23 Receptacle Wall
24 Upper Wall
25 Water Filter Air Exit Post
26 Underwater Aperture
27 Water Filter Air Intake
28 Lower Wall
29 Rear Wing
30 Front Wing
31 Peripheral Shield
32 Receptacle Ground
33 Filter Lid
34 Discharging Aperture
35 Above Water Windows
36 Evacuation Extension Guiding Slit
37 Receptacle Motor Wall The vacuum cleaner according to the present invention comprises a main housing (1) incorporating a water receptacle (2) in which filtering is carried out. A receptacle lid (3) covering said water receptacle (2), a receptacle handle (4), a water filter (5) and an air evacuation shaft (18) constitute the main components in said receptacle (2).

The main housing (1) mainly presents a horizontally extending body movable on wheels located on both sides. An electrical motor (8) is secured in the rear side of said main housing (1). The front part of the housing (1) comprises a planar lower body portion (9) for receiving said water receptacle (2) and an upwardly projecting part (21) in the vicinity thereof, in which said motor (8) is situated. The suction hose enters the body at a junction (7) on the front part of the housing (1), said junction (7) directly leading sucked air to an inlet shaft (17) of the water filter (5). The rear part of the apparatus typically comprises a cable reel or drum intended to be used for reeling in, storage, and reeling out of the cable, a control panel that fulfills various functions and an air filter (10).

A separate housing handle (11) independent of the receptacle handle (4) allows users to lift the apparatus and carry it in an appropriate manner. The water receptacle (2) according to the present invention is designed to be seated on the underlying surface, i.e. the planar lower body (9) of the main housing (1). The suction hose junction (7) in a suction hose slot (12) comprises a sealing element (14) for preventing escape of dust and air into the surrounding environment. Likewise, another sealing (14) is employed on the motor projection (21) where said receptacle's (2) emptied portion (13) is secured onto said main housing (1). These sealing elements (14) provide that air circulated through the water receptacle (2) is not allowed out during intake and outtake.

In the event that water is spilled over the surface of the main housing (1) and over the lower body portion (9) on which said receptacle (2) is secured, a pair of water evacuation openings (15) are provided to allow easier discharge of leakage water.

A conventional dry type air filter (10) on the rear part of the apparatus is mounted and fixed thereon by means of a pair of clips (16). The air filter (10) conventionally filters air taken from the motor (8).

The water receptacle (2) according to the present invention is the core of the filtering process according to which air sucked by vacuuming is circulated through said water filter (5) and dust in the form of fine particles in the sucked air is filtered out. The water receptacle (2) comprises a filtering means (5) guiding vacuumed air into water surface as explained hereinafter in detail.

An air evacuation extension (6) guides filtered air under vacuuming action such that building up of water ways on the inner surface of the receptacle lid (3) on top of the motor region is prevented. This eliminates risk of liquid leakage into the motor components. Water ways on the inner surface of the receptacle lid (3) is mainly comprised of a large number of water droplets reaching the upper surface of the receptacle (2) due to a large number of bubbles rising to the water surface and collapsing under vacuuming action. Therefore, the present invention proposes an air evacuation extension (6) taking air at a region of the receptacle (2) where the water filter (5) is present. The region where said emptied portion (13) of the receptacle (2) being directly in contact with said motor projection (21).

The water receptacle (2) should be filled with water at a level where a pair of windows (35) of an air exit post (25) lies above the water level. Said air exit post (25) also comprise underwater apertures (26) greater in size in terms of the largest distance parallel to water level compared to said windows (35) above the water level.

The water filter (5) according to the present invention essentially comprises an air inlet shaft (17) where sucked air at the hose junction (7) is directed first to the inlet shaft (17), then through a pair of lateral air exit post (25), to the underwater apertures (26) and windows (35) above the water level. Sucked air first reaches an inner wall (24) of the filter before advancing to the air exit post (25). The receptacle (2) should normally be filled with water at a level in between these two sets of windows (respectively 26 and 35). The two sets of openings (26 and 35) extending opposite the vacuuming direction according to the invention ensure that particles in the air are to be filtered out more efficiently. The lowermost surfaces of the air exit post (25) being closed provides the effect that air is directed in the reverse direction of the vacuuming, i.e. air is directed in the direction of the suction hose junction (7). Dust and particles now contained in the water advance in the direction of the receptacle wall (23) and then upwards in the direction of the intermediate wall (28), rear and front wings (29, 30) and peripheral shield (31). Therefore the intermediate wall (28) extending peripherally parallel to the receptacle ground (32) in between the filter (5) upper body and the receptacle (2) upper rim such that an liquid tight connection is established, said rear and front wings (29, 30) extending perpendicular to said receptacle ground (32) and peripheral shield (31) extending around said rear wing (29) and said intermediate wall (28) in the manner to bear against the receptacle wall (23) such that no liquid communication is allowed, ensure that dust and particles entrapped in the water are kept circulating within a region defined by said receptacle wall (23), rear and front wings (29, 30) and peripheral shield (31) and continuously re-directed to said receptacle ground (32). This ensures that dust and particles are increasingly more entrapped in water, maximum contact with water is ensured and adhesion forces are increased. To this end, a precipitate forms on the receptacle ground (32), which in turn provides that air discharged into the surrounding environment is clean.

The front wings (29), on the other hand, extend adjacent to the receptacle wall (23 portion neighboring the suction hose slot (12) in the form of two lines around said suction hose slot (12) in the direction of the longitudinal axis of the same. Said air exit posts (25) extend longitudinally parallel in the direction of the longitudinal axis of said suction hose slot (12). Each air exit post (25) face a receptacle (2) region divided by said suction hose slot (12). Therefore air released form said posts (25) advances in the direction of a receptacle region delimited by the receptacle wall (23) and the wall surrounding said suction hose slot (12).

The configuration of the motor (8) with respect to the water receptacle (2) according to the present invention ensures that the water receptacle (2) is locked on the lower body portion (9) of the main housing (1) during operation of the motor (8). The locking effect of the vacuum is removed when said motor (8) is turned off, upon which a user can easily dismantle and lift said water receptacle (2) by means of said receptacle handle (4).

The lowermost point of the inlet shaft (17) of the water filter (2) according to the present invention is at a longitudinally lower level with respect to the lowermost point of the air evacuation shaft (18) of the evacuation extension (6). The evacuation shaft (18) lying higher that said inlet shaft (17) ensures that water in the receptacle (2) does not advance towards the evacuation extension (6) in the form of water droplets under vacuuming action. The air evacuation extension's (6) air intake opening extending adjacent to the receptacle lid (3), i.e. in the uppermost region of the receptacle (2), also ensure that water droplets cannot reach the air intake opening. Said air evacuation extension's (6) evacuation shaft (18) has a longitudinal axis coaxial to that of the motor projection (21) on which said motor air intake grid (22) is positioned centrally. The air evacuation extension's (6) air intake opening bears against the rear portion of the water filter, i.e. against a portion where no direct air communication from the inside region of the filter (5) is possible.

A receptacle motor wall (37) provides a physical barrier such that particles entrapped in the water are not circulated to the air evacuation extension (6) region and remain in the water. Upon mounting of the water filter (5) in the receptacle (2), said inlet shaft (17) is secured to the water receptacle (2) such that no fluid communication in between said receptacle (2) and said inlet shaft (17) is present.

The invention claimed is:

1. A vacuum cleaner comprising a water receptacle having a water filter, said water receptacle having a front part and a rear part, said rear part comprising an air evacuation shaft in communication with a motor at a lower end of said motor such that the bottom surface of said receptacle is perpendicular to the longitudinal axis of said air evacuation shaft and said front part is designed to accommodate a suction hose slot, said suction hose coaxially communicating with an inlet shaft of said water filter at a lower end of said water filter, said inlet shaft extending perpendicular to the bottom surface of said water receptacle wherein;

said rear part of said receptacle comprises an emptied part receiving a motor projection from the lower end of the motor such that the bottom surface of said receptacle is perpendicular to the longitudinal axis of said motor and, said evacuation shaft is vacuum locked with said motor to be extending coaxially with respect to said motor's longitudinal axis such that said water receptacle is removably fixed on the lower body portion of the main housing during operation of the motor.

2. A vacuum cleaner as set forth in claim 1, wherein said front part of said receptacle comprises an emptied front part designed to accommodate said suction hose slot.

3. A vacuum cleaner as set forth in claim 2, wherein said receptacle comprises a handle.

4. A vacuum cleaner as set forth in claim 3, wherein said vacuum cleaner comprises a main housing having a front part with a planar lower body portion for receiving said water receptacle and an upwardly projecting part in the vicinity thereof, in which said motor is situated.

5. A vacuum cleaner as set forth in claim 4, wherein said housing of said vacuum cleaner comprises a handle.

6. A vacuum cleaner as set forth in claim 5, wherein said lower body portion of said housing on which said receptacle is secured comprises at least one water evacuation opening allowing easier discharge of leakage water.

* * * * *